US010612241B2

(12) United States Patent
Wang et al.

(10) Patent No.: US 10,612,241 B2
(45) Date of Patent: Apr. 7, 2020

(54) APPARATUS FOR PRESTRESSING CONCRETE FLOOR OF INCLINED SHAFT WALL

(71) Applicant: CHINA UNIVERSITY OF MINING AND TECHNOLOGY, Xuzhou, Jiangsu (CN)

(72) Inventors: Yansen Wang, Jiangsu (CN); Chenxiang Meng, Jiangsu (CN); Weihao Yang, Jiangsu (CN); Ran Yang, Jiangsu (CN)

(73) Assignee: CHINA UNIVERSITY OF MINING AND TECHNOLOGY, Xuzhou, Jiangsu (CN)

( * ) Notice: Subject to any disclaimer, the term of this patent is extended or adjusted under 35 U.S.C. 154(b) by 0 days.

(21) Appl. No.: 16/301,413

(22) PCT Filed: Dec. 1, 2017

(86) PCT No.: PCT/CN2017/114231
§ 371 (c)(1),
(2) Date: Nov. 13, 2018

(87) PCT Pub. No.: WO2018/161649
PCT Pub. Date: Sep. 13, 2018

(65) Prior Publication Data

US 2019/0383016 A1 Dec. 19, 2019

(30) Foreign Application Priority Data

Mar. 7, 2017 (CN) ..... 2017 1 0129849

(51) Int. Cl.
*E04C 5/08* (2006.01)
*E04B 5/32* (2006.01)
*E21D 11/10* (2006.01)

(52) U.S. Cl.
CPC ..... *E04C 5/08* (2013.01); *E04B 5/32* (2013.01); *E21D 11/107* (2013.01); *E04B 2103/02* (2013.01)

(58) Field of Classification Search
CPC ..... E04C 5/08; E04B 5/32; E04B 2103/02; E21D 11/107; E21B 49/00; E21B 49/006
See application file for complete search history.

(56) References Cited

U.S. PATENT DOCUMENTS 3,089,215 A * 5/1963 Stubbs ..... E01C 11/20 425/111
3,863,891 A 2/1975 Leonte
(Continued)

FOREIGN PATENT DOCUMENTS

CN 1594834 A 3/2005
CN 101737069 A 6/2010
(Continued)

OTHER PUBLICATIONS

English Translation of the Search Report and Written Opinion for PCT/CN2017/114231 (10 pages). (Year: 2019).*
(Continued)

*Primary Examiner* — Rodney Mintz
(74) *Attorney, Agent, or Firm* — Seed Intellectual Property Law Group LLP

(57) ABSTRACT

An apparatus for prestressing a concrete floor of an inclined shaft wall includes two end bearing components, a corrugated pipe, a tension bearing rod piece and two anchor heads. The tension bearing rod piece is composed of a left tension bearing rod, a right tension bearing rod, and a loading mechanism. The left tension bearing rod and the right tension bearing rod, are connected integratedly by the loading mechanism, and the tension bearing rod piece passes through the corrugated pipe. The two end bearing components are respectively arranged at the left and right ends of
(Continued)

the tension bearing rod piece in a sleeving manner. The two anchor heads respectively lock the left and right end bearing components. Before pouring of the floor of the shaft wall, the loading apparatus is pre-buried. After the strength of floor concrete increases to certain extent, a transverse pre-pressing stress is applied to the floor concrete through the loading mechanism. Finally, an internal space of the loading apparatus is blocked by grouting, so as to integrate the tension bearing component, the loading apparatus and the like with the floor concrete.

4 Claims, 8 Drawing Sheets

(56) References Cited

U.S. PATENT DOCUMENTS 3,952,468 A * 4/1976 Soum ..... E04B 1/22 52/223.13
6,655,104 B2 * 12/2003 Kadotani ..... E04C 5/08 52/647
7,886,490 B2 * 2/2011 Maekawa ..... E02D 5/808 52/223.14
9,404,254 B2 * 8/2016 Reigstad ..... E04B 5/32
9,410,316 B2 * 8/2016 Reigstad ..... E04B 5/32
9,644,369 B2 * 5/2017 Reigstad ..... E04B 5/023
9,783,987 B2 * 10/2017 Gan ..... E02D 5/30
10,024,047 B2 * 7/2018 Zavitz ..... E04C 3/34
2002/0157333 A1 * 10/2002 Kadotani ..... E04C 5/08 52/223.2
2010/0050546 A1 * 3/2010 Maekawa ..... E02D 5/808 52/223.13
2015/0176276 A1 * 6/2015 Reigstad ..... E04B 5/32 52/223.6
2015/0176277 A1 * 6/2015 Reigstad ..... E04B 5/32 52/223.6
2015/0176278 A1 * 6/2015 Reigstad ..... E04B 5/32 52/223.6
2016/0333583 A1 * 11/2016 Gan ..... E02D 5/30
2016/0340902 A1 * 11/2016 Reigstad ..... E04B 5/023
2017/0051495 A1 * 2/2017 Zavitz ..... E04C 3/34
2017/0204609 A1 * 7/2017 Reigstad ..... E04B 5/023
2018/0291612 A1 * 10/2018 Zavitz ..... E04B 1/4157

FOREIGN PATENT DOCUMENTS

CN 102777197 A 11/2012
CN 105201514 A 12/2015
CN 106884651 A 6/2017

OTHER PUBLICATIONS

Australian Examination Report No. 1 for Application No. 2017402485 (4 pages). (Year: 2019).*

* cited by examiner

APPARATUS FOR PRESTRESSING CONCRETE FLOOR OF INCLINED SHAFT WALL

BACKGROUND

Technical Field

The present disclosure relates to an apparatus for prestressing a concrete floor of an inclined shaft wall, which is applicable to supporting and protecting engineering for inclined shafts, tunnels, roadways, chambers and the like in high-water-pressure and high-expansion stratums in the fields of mine construction, water conservancy, traffic, municipal administration and the like.

Description of the Related Art

In stratums with large burial depths and high water pressures, there are such waterproof requirements for design and construction of inclined shaft walls that floors of the shaft walls must make sure that no tension failures occur on upper surfaces under the high water pressures. However, due to the characteristics that concrete is pressure-proof but lack of tensile strength, the floor of the inclined shaft wall often has an extremely large design thickness and extremely high steel content, or even the floor must be designed as an inverted arch with a small curvature radius, which greatly increases the construction difficulty. Even so, floor concrete of the shaft wall still often causes a sudden water burst and even a mine flooding accident because of top surface cracking.

At present, most of inclined shaft walls in water-bearing stratums are designed as flat and straight floor structures or "flat-top and curved-bottom" concrete slab structures with bottom surfaces having certain radians. Due to the limitation of a construction process, it is very difficult to design the floor as an inverted arch structure with an extremely small curvature radius, resulting in that the floor structure of the shaft wall often hardly meets a requirement for resisting a high water pressure at the lower part, thereby remaining a risk of bending and tension failures caused by a bulged middle part of the floor. Therefore, for the inclined shaft walls with non-circular interfaces in the water-bearing stratums, it is in urgent need of taking measures to prevent the bending and tension failures of the floors.

BRIEF SUMMARY

Embodiments of the present invention provide an apparatus for prestressing a concrete floor of an inclined shaft wall in allusion to an existing inclined shaft wall construction process based on an idea of prestressing concrete structure, and the prestressing apparatus is applied to prestressing of the concrete floor of the shaft wall, which substantially improves the tensile strength of the floor of the shaft wall and practically and effectively reduces the thickness and the steel use amount of the floor, thereby fulfilling the aims of improving the engineering safety and reducing the engineering cost.

An apparatus for prestressing a concrete floor of an inclined shaft wall of an embodiment of the present invention includes two end bearing components, a corrugated pipe, a tension bearing rod piece and two anchor heads. The tension bearing rod piece is composed of a left tension bearing rod, a right tension bearing rod and a loading mechanism. The left tension bearing rod and the right tension bearing rod are connected integratedly via the loading mechanism, and the tension bearing rod piece passes through the corrugated pipe, with two ends exposed by a set length. The two end bearing components are respectively arranged at the left and right ends of the tension bearing rod piece in a sleeving manner. The two anchor heads respectively lock the left and right end bearing components.

A further optimized solution is that the prestressing apparatus further includes a loading box. The loading box is closed with a cover. The corrugated pipe is divided into two sections which are arranged on two sides of the loading box and in communication with the loading box. The loading mechanism is located in the loading box.

A grouting hole is provided on the loading box, so as to be connected to a grouting pipe (10) to perform grouting blocking after prestress application is completed. An exhaust hole is provided on an outer end part of the corrugated pipe, and is used for exhausting gas during grouting in the corrugated pipe.

The end bearing components are channel steel, I-shaped steel or steel plates.

The loading mechanism may select the following several structural forms for prestressing:

a first loading mechanism is an internal threaded sleeve, an internal thread of which is divided into a left part and a right part. Thread directions of the two parts are opposite. The end parts of the left tension bearing rod and the right tension bearing rod are respectively provided with male threads matched with the internal thread parts of the internal threaded sleeve, so that the end parts of the left tension bearing rod and the right tension bearing rod are respectively screwed into the internal threaded sleeve. Tensioning is carried out by screwing the internal threaded sleeve to apply a tension stress to the tension bearing rods on both sides.

A second loading mechanism is composed of a U-shaped connection piece, a baffle plate and two nuts. A back side of a curved section of the U-shaped connection piece is connected to the left tension bearing rod. The baffle plate is fixed at the end part of the right tension bearing rod. Two ends of the baffle plate are provided with two holes, and are arranged on two legs of the U-shaped connection piece in a sleeving manner. The two legs of the U-shaped connection piece are provided with male threads. The two nuts are respectively screwed onto the two legs of the U-shaped connection piece. A prestress is applied to the tension bearing rods by screwing the nuts.

A third loading mechanism is composed of a work anchor, a tool anchor and two jacks. Two left tension bearing rods are provided, the end parts of which are symmetrically fixed on two sides of the work anchor. The other ends of the left tension bearing rods are connected to the anchor heads in one of the following two ways:

the first one is that the two left tension bearing rods pass through a same hole in each of the anchor heads and then are fixed, and the second one is that the two left tension bearing rods respectively pass through two holes in each of the anchor heads and then are fixed.

The middle part of the work anchor is provided with a conical hole. The head part of the right tension bearing rod passes through the middle conical hole of the work anchor at first, then passes through a preset conical hole in the tool anchor, and enables the right tension bearing rod to be self-locked onto the work anchor and the tool anchor through clamps.

The two jacks are placed between the work anchor (14) and the tool anchor (15) symmetrically.

The apparatus for prestressing the concrete floor of the inclined shaft wall of an embodiment of the present invention is used for loading the prestress to the floor of the inclined shaft wall, and solves the difficulty in prestressing in a narrow space of the floor of the shaft wall. By the application of the prestress, the bending and tension resistance properties of the floor structure of the shaft wall under high external water pressure and high surrounding rock pressure may be substantially improved, the safety is improved, and the engineering cost is substantially reduced.

DETAILED DESCRIPTION

Figure 1:
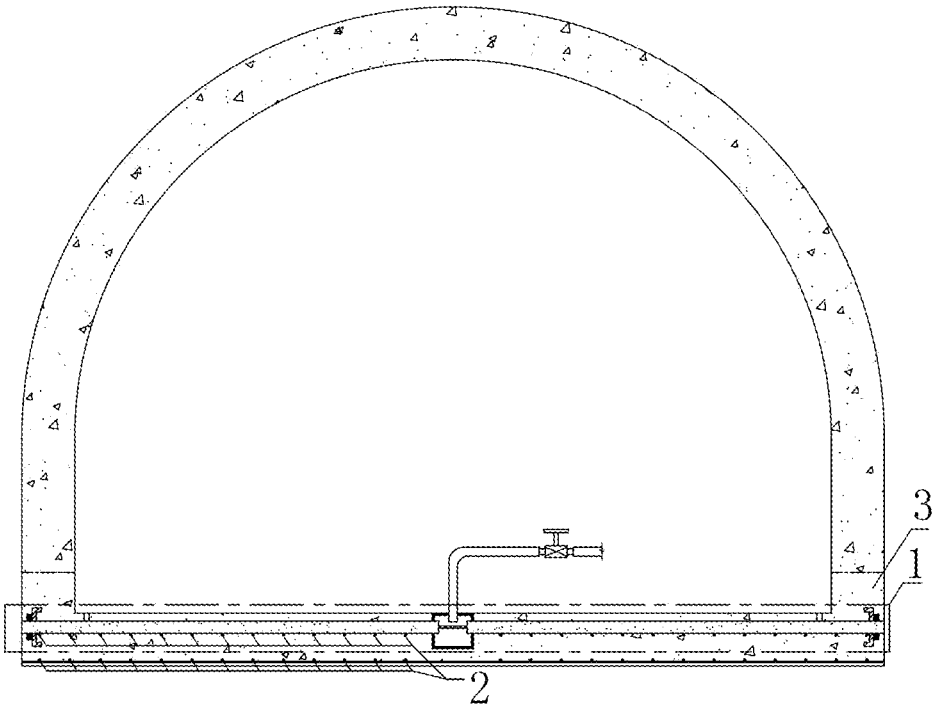
FIG. 1 is a cross-sectional schematic diagram of an inclined shaft wall with a flat and straight floor.
Figure 2:
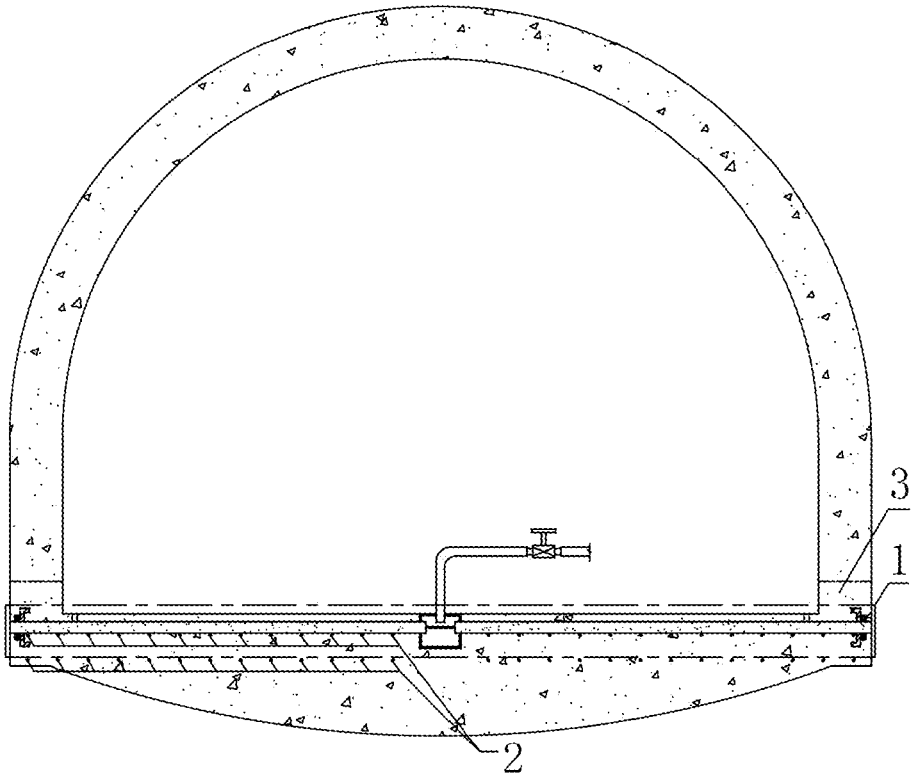
FIG. 2 is a cross-sectional schematic diagram of an inclined shaft wall with a "flat and straight-top and inverted arch-bottom" floor.

In embodiments of the present invention, a prestressed floor structure of an inclined shaft wall, as shown in FIG. 1 and FIG. 2, is composed of an apparatus 1 for prestressing a concrete floor of an inclined shaft wall of an embodiment of the present invention (hereinafter referred to as the loading apparatus), a steel framework 2 and concrete 3 wrapped around. End bearing components and a tension bearing rod piece of the loading apparatus 1 may be directly combined with the steel framework 2, so that the loading apparatus 1 and the original steel framework 2 form a new space system. The loading apparatus 1 may also replace part of steel bars on a tension side as required.

The concrete 3 wrapped around is concrete required for general shaft wall pouring.

The steel framework 2 is a metal framework, such as steel bar or profile steel, bound before shaft wall concrete pouring.

The apparatus 1 for prestressing the concrete floor of the inclined shaft wall of an embodiment of the present invention includes two end bearing components 4, a corrugated pipe 5, a tension bearing rod piece 6 and two anchor heads 7. The tension bearing rod piece 6 is composed of a left tension bearing rod, a right tension bearing rod and a loading mechanism. The left tension bearing rod and the right tension bearing rod are connected integratedly via the loading mechanism, and the tension bearing rod piece passes through the corrugated pipe, with two ends exposed by a set length. The two end bearing components 4 are respectively arranged at the left and right ends of the tension bearing rod piece in a sleeving manner. The two anchor heads 7 respectively lock the left and right end bearing components. The prestressing apparatus further includes a loading box 8. The loading box is closed with a cover. A top surface box cover of the loading box may be opened and provided with a grouting hole 17 which can be connected to a grouting pipe 10 to perform grouting blocking after prestress application is completed. The corrugated pipe 5 is divided into two sections which are arranged on two sides of the loading box and in communication with the loading box. The loading mechanism is located in the loading box. Exhaust holes 11 are provided on the end parts of the left and right ends of the corrugated pipe, and are used for exhausting gas during grouting in the corrugated pipe.

The apparatus 1 for prestressing the concrete floor of the inclined shaft wall of an embodiment of the present invention is flexibly arranged along a direction perpendicular to an axial direction of an inclined shaft wellbore, or may be arranged in an equal or unequal spacing manner along the axial direction of the inclined shaft wellbore. After installation, the concrete floor is poured. After concrete is solidified, the loading box cover is opened, and a prestress is loaded to the floor through the loading mechanism according to set parameter values. The loading box cover is closed, and the grouting pipe 10 is connected to grout concrete into a threaded pipe.

The loading mechanism of the loading apparatus 1 in an embodiment of the present invention may select (but not limited to) the following several forms. Detailed descriptions are made specifically in combination with the drawings.

Embodiment 1

Figure 3:
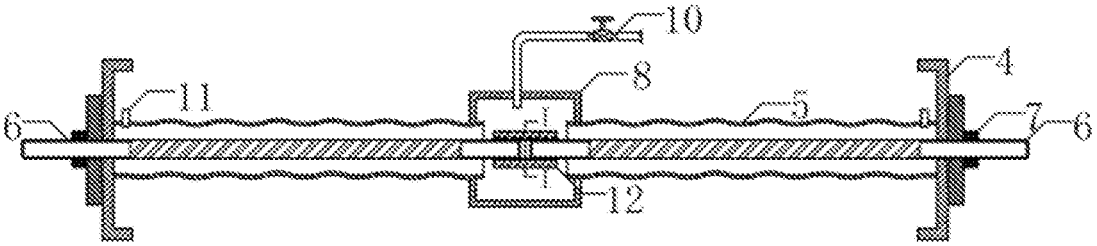
FIG. 3 is a schematic diagram of a longitudinal section of an apparatus for prestressing a concrete floor of an inclined shaft wall of an embodiment of the present invention (end bearing components are channel steel, and a loading mechanism is an internal threaded sleeve).
Figure 4:
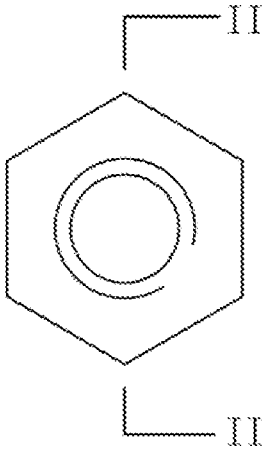
FIG. 4 is a cutaway view of I-I in FIG. 3.
Figure 5:
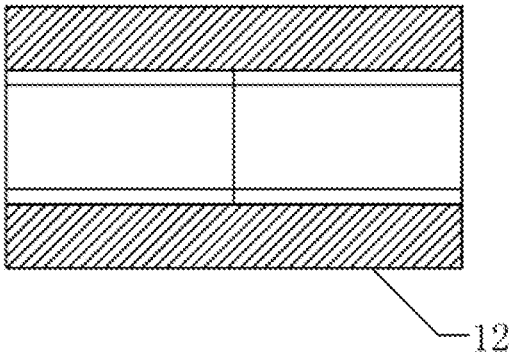
FIG. 5 is a cutaway view of II-II in FIG. 4.

As shown in FIGS. 3, 4 and 5, according to the apparatus 1 for prestressing the concrete floor of the inclined shaft wall, the two end bearing components 4 are channel steel, and are respectively arranged at the left and right ends of the tension bearing rod piece 6. The tension bearing rod piece 6 is composed of a left tension bearing rod, a right tension bearing rod and a loading mechanism. The loading mechanism is an internal threaded sleeve 12, an internal thread of which is divided into a left part and a right part. Thread directions of the two parts are opposite. The head parts of the left tension bearing rod and the right tension bearing rod are respectively provided with male threads matched with the internal thread parts of the internal threaded sleeve, so that the end parts of the left tension bearing rod and the right tension bearing rod are respectively screwed into the internal threaded sleeve. Tensioning is carried out by screwing the internal threaded sleeve to apply a tension stress to the tension bearing rods on both sides. The tension bearing rod piece 6 passes through the corrugated pipe 5, with two ends exposed by a set length. The two anchor heads 7 respectively locks the positions of the left and right end bearing components. The loading mechanism is just arranged in the loading box 8. In the present embodiment, the inclined shaft wall adopts a flat and straight floor (see FIG. 1). The end bearing components 4 are the channel steel, and the loading mechanism is the internal threaded sleeve (see FIG. 3).

A specific construction method which applies the apparatus 1 for prestressing the concrete floor of the inclined shaft wall of an embodiment of the present invention includes:

(1) after the inclined shaft wellbore is dug, before the floor of the shaft wall is poured, firstly binding steel bars or profile steel to form a spatial metal framework structure.

(2) in a binding and fixing process of the spatial metal framework, installing and fixing the end bearing components 4, the corrugated pipe 5 and the tension bearing rod piece 6 in sequence according to designed positions, wherein the tension bearing rod piece 6 passes through the corrugated pipe 5 from the inside of the corrugated pipe 5, and is connected to the end bearing components 4 through the anchor heads 7, and exhaust pipes 11 located on the corrugated pipe 5 shall be slightly higher than the top surface of the floor of the shaft wall and closed.

(3) mounting the loading box 8 at a middle position between the two sections of the corrugated pipe 5, wherein the loading mechanism (the internal threaded sleeve 12) is located in the loading box 8, and the surface of the loading box cover shall be flush with the upper surface of the floor of the shaft wall.

(4) mounting a shaft wall floor template (if required), pouring floor concrete, removing the template when the concrete strength increases to certain extent, chiseling the concrete, and opening a top cover of the loading box 8.

(5) applying a tension stress to the tension bearing rod piece 6 by screwing the loading mechanism, namely the internal threaded sleeve 12, and applying a prepressing stress to the floor concrete under the dispersing action of the end bearing components 4.

Figure 15:
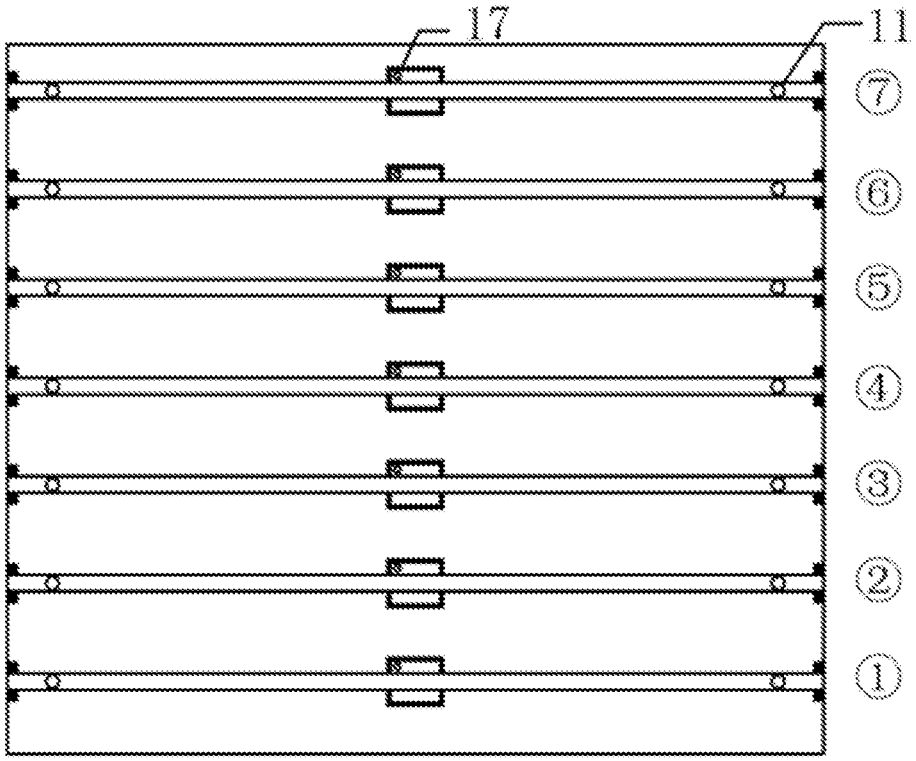
FIG. 15 is a schematic diagram of arrangement of prestressing apparatuses for a concrete floor of an inclined shaft wall of an embodiment of the present invention along an axial direction of a wellbore.

(6) in order to improve the uniformity of floor prestress application, firstly loading the prestress continuously or at intervals along the axial direction of the well bore (see FIG. 15), wherein for example, the loading apparatuses 1 numbered ①③⑤⑦ are firstly used for loading the prestress, and the loading apparatuses 1 numbered ②④⑥ are then used for loading the prestress. In addition, each group of tension bearing rod piece 6 is subjected to loading step by step. Uniform loading for the floor of the same section of shaft wall is realized by reducing the size of each stage of load and increasing the number of loading stages. During loading, the sizes of each stage of load and a final load shall be controlled through a torque wrench or other tools to improve a uniform prestress.

(7) after the prestress application to the floor of the shaft wall is completed, opening the exhaust pipes 11, closing the top cover of the loading box 8, connecting the grouting pipe 10 so as to grout and fill internal spaces of the corrugated pipe 5 and the loading box 8 so as to integrate the tension bearing rod piece, the loading apparatus and the like with the floor concrete to avoid rust corrosion to the components and prestress loss.

Embodiment 2

Figure 6:
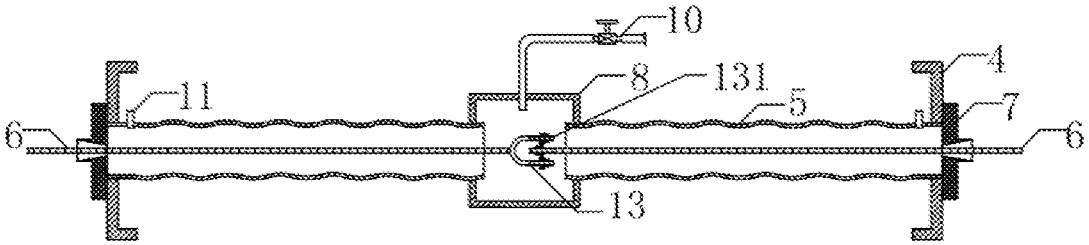
FIG. 6 is a schematic diagram of a longitudinal section of an apparatus for prestressing a concrete floor of an inclined shaft wall of an embodiment of the present invention (a loading mechanism is a U-shaped connection piece).
Figure 7:
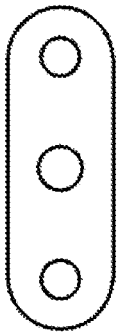
FIG. 7 is a schematic diagram of a baffle plate 131 matched with the U-shaped connection piece.

The floor structure of the inclined shaft wall of the present embodiment is basically the same as that of Embodiment 1, and also adopts a flat and straight floor (see FIG. 1). A difference is that the loading mechanism is composed of a U-shaped connection piece 13, a baffle plate 131 and three nuts (see FIG. 6). A back side of a curved section of the U-shaped connection piece 13 is connected to the left tension bearing rod. As shown in FIG. 7, totally three through holes are provided on the baffle plate 131. One through hole is located in the center, and the other two through holes are symmetrically disposed along a long axis of the baffle plate. The head part of the right tension bearing rod is provided with a male thread. After the right tension bearing rod passes through the middle through hole, one nut is screwed onto the head part of the tension bearing rod to fix it. The two holes in two ends of the baffle plate are respectively placed on two legs of the U-shaped connection piece 13 in a sleeving manner. The two legs of the U-shaped connection piece are provided with male threads, and the other two nuts are respectively screwed onto the two legs of the U-shaped connection piece. The prestress is applied to the tension bearing rods by screwing the nuts on the two legs of the U-shaped piece or the nut in the center of the baffle plate. In the present embodiment, the whole structure may be transpositioned left and right. The transpositioned structure is completely the same as that of the present embodiment, so that the descriptions thereof are omitted herein. A specific construction method which applies the apparatus 1 for prestressing the concrete floor of the inclined shaft wall of an embodiment of the present invention is as follows:

the construction method involved in the present embodiment is basically the same as that in Embodiment 1. A difference is that in Step 5, the tension bearing rod piece is gradually tightened to apply the prestress by screwing the two nuts on the U-shaped connection piece 13 or the nut in the center of the baffle plate, thereby applying a tension stress to the tension bearing rod piece 6 and applying a prepressing stress to the floor concrete under the dispersing action of the end bearing components 4.

Embodiment 3

Figure 8:
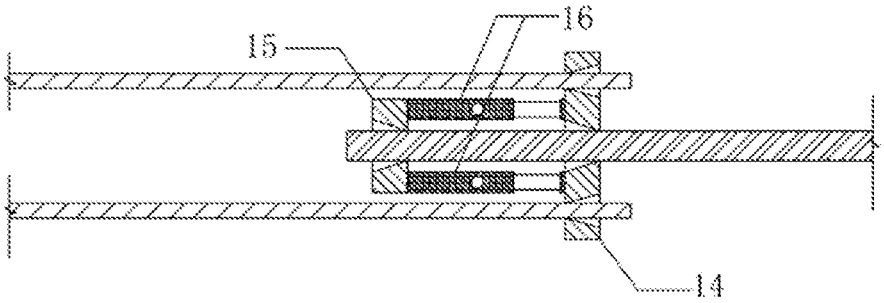
FIG. 8 is a partially structural schematic diagram of an apparatus for prestressing a concrete floor of an inclined shaft wall of an embodiment of the present invention (a loading mechanism is of an anchor gear structure consisting of a work anchor, a tool anchor and two jacks).
Figure 9:
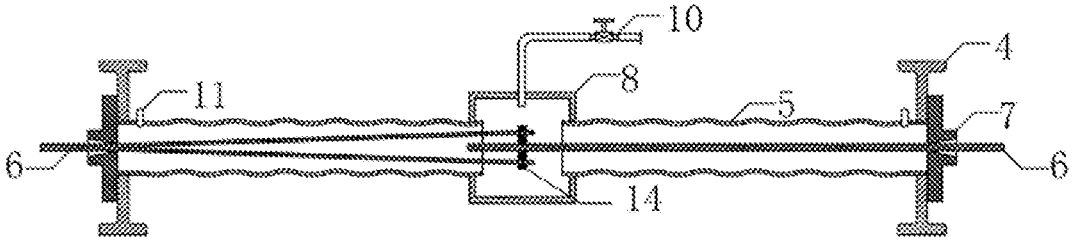
FIG. 9 is a structural schematic diagram of an apparatus for prestressing a concrete floor of an inclined shaft wall of an embodiment of the present invention (after the prestress is loaded, a tool anchor and two jacks of a loading mechanism are removed, and two left tension bearing rods pass through the same hole in each of anchor heads and then are fixed).
Figure 10:
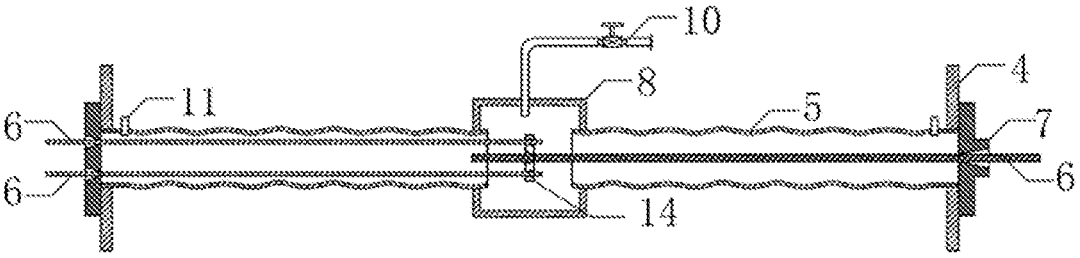
FIG. 10 is a structural schematic diagram of an apparatus for prestressing a concrete floor of an inclined shaft wall of an embodiment of the present invention (after the prestress is loaded, a tool anchor and two jacks of a loading mechanism are removed, and two left tension bearing rods respectively pass through two holes in each of anchor heads and then are fixed).
Figure 11:
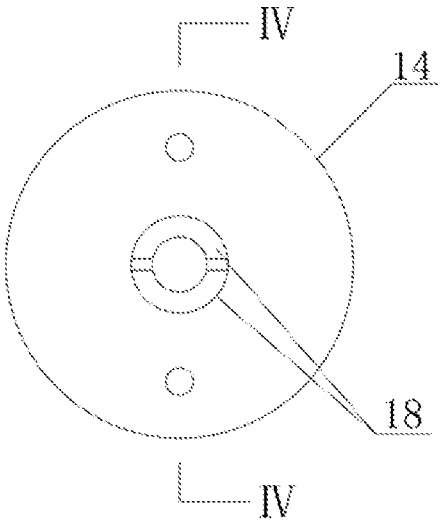
FIG. 11 is a front view of a work anchor 14.
Figure 12:
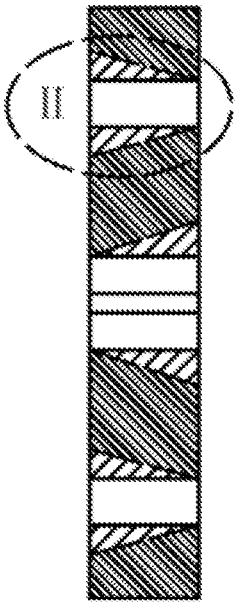
FIG. 12 is a cutaway view of IV-IV in FIG. 11.
Figure 13:
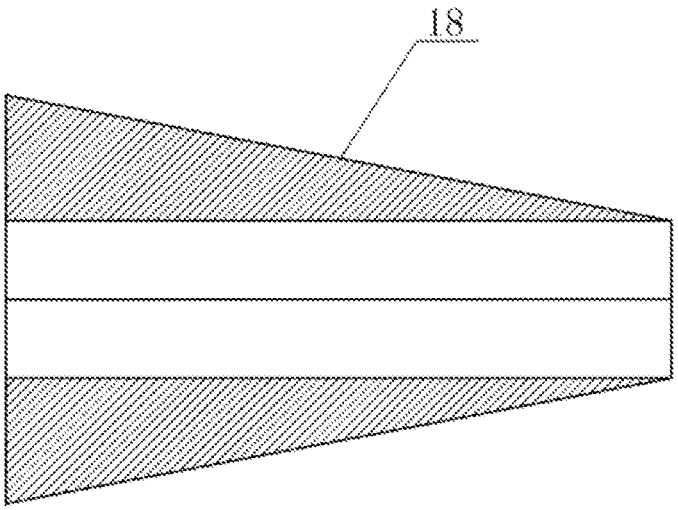
FIG. 13 is a longitudinal-sectional view of a clamp used as a work anchor matching assembly.
Figure 14:
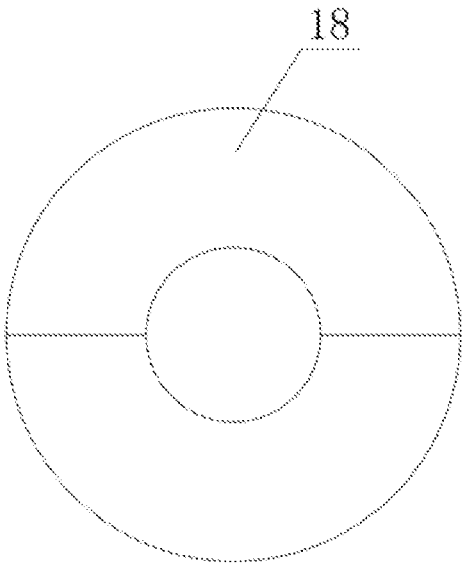
FIG. 14 is an end view of a clamp used as a work anchor matching assembly.

The floor structure of the inclined shaft wall of the present embodiment is basically the same as that in Embodiment 1, but adopts a "flat and straight-top and inverted arch-bottom" floor (see FIG. 2). A difference is that the end bearing components 4 are I-shaped steel. The loading mechanism is composed of a work anchor 14, a tool anchor 15 and two jacks 16 (see FIG. 8). As shown in FIGS. 11 and 12, three conical holes are provided on the work anchor. One conical hole (a middle conical hole) is provided on the center of the work anchor, and the other two conical holes are symmetrically disposed in two sides of the central hole. The direction of the middle conical hole is opposite to those of the conical holes in both sides. Two left tension bearing rods are provided, the head parts of which respectively pass through the conical holes in both sides and are self-locked onto the work anchor 14 through clamps 18. The head part of the right tension bearing rod passes through the conical hole in the center of the work anchor, then passes through a middle conical hole of the tool anchor, and is self-locked onto the work anchor 14 and the tool anchor 15 respectively through two clamps 18. The clamps 18 are as shown in FIG. 13 and FIG. 14. The other ends of the left tension bearing rods are connected to the anchor heads 7 in one of the following two ways:

as shown in FIG. 9, the first one is that the two left tension bearing rods pass through a same hole in each of the anchor heads 7 and then are fixed; and as shown in FIG. 10, the second one is that the two left tension bearing rods respectively pass through two holes in each of the anchor heads 7 and then are fixed.

The jacks 16 are mounted between the tool anchor and the work anchor. The prestress is applied through the jacks. After the prestress application is completed, the tool anchor and the jacks may be removed.

A specific construction method which applies the apparatus 1 for prestressing the concrete floor of the inclined shaft wall of an embodiment of the present invention is as follows:

the construction method involved in the present embodiment is basically the same as that in Embodiment 1. A difference is that in Step 5, through cooperation with one tool anchor 15, the two jacks 16 are placed between the tool anchor 15 and the work anchor 14. The work anchor 14 is pushed forwards through a force applied by the jacks. After the prestress is increased to a predetermined value, the force of the jacks 16 is released, and the work anchor 14 completes self-locking through its clamping sheets 18 to maintain the applied prestress, thereby enabling the tension bearing rod piece 6 to be in a tension state and applying a prepressing stress to the floor concrete under the dispersing action of the end bearing components 4. For selection of jacks in an implementation process, in consideration of a limited space in a metal box, a small-sized jack screw may be used for replacing a conventional hydraulic jack. In consideration of the size of a jacking force, two jack screws are symmetrically provided. After the prestress application is completed, the tool anchor and the jacks may be removed.

In general, in the following claims, the terms used should not be construed to limit the claims to the specific embodiments disclosed in the specification and the claims, but should be construed to include all possible embodiments along with the full scope of equivalents to which such claims are entitled.

What is claimed is:

1. An apparatus for prestressing a concrete floor of an inclined shaft wall, comprising:

two end bearing components;

a corrugated pipe;

a tension bearing rod piece;

two anchor heads; and a loading box;

wherein the tension bearing rod piece is composed of a left tension bearing rod, a right tension bearing rod, and a loading mechanism;

wherein the left tension bearing rod and the right tension bearing rod are connected integratedly by the loading mechanism;

wherein the tension bearing rod piece passes through the corrugated pipe, with two ends exposed by a set length;

wherein the two end bearing components are respectively arranged at a left end and a right end of the tension bearing rod piece in a sleeving manner;

wherein the two anchor heads respectively lock the left and right end bearing components;

wherein the loading box is closed with a cover;

wherein the corrugated pipe is divided into two sections which are arranged on two sides of the loading box and in communication with the loading box;

wherein the loading mechanism is located in the loading box;

wherein a grouting hole is provided on the loading box; and wherein an exhaust hole is provided on an outer end part of the corrugated pipe.

2. An apparatus for prestressing a concrete floor of an inclined shaft wall, comprising:

two end bearing components;

a corrugated pipe;

a tension bearing rod piece; and two anchor heads;

wherein the tension bearing rod piece is composed of a left tension bearing rod, a right tension bearing rod, and a loading mechanism;

wherein the left tension bearing rod and the right tension bearing rod are connected integratedly by the loading mechanism;

wherein the tension bearing rod piece passes through the corrugated pipe, with two ends exposed by a set length;

wherein the two end bearing components are respectively arranged at a left end and a right end of the tension bearing rod piece in a sleeving manner;

wherein the two anchor heads respectively lock the left and right end bearing components;

wherein the loading mechanism is an internal threaded sleeve;

wherein an internal thread of the internal threaded sleeve is divided into a left part and a right part;

wherein thread directions of the left and right parts are opposite;

wherein end parts of the left tension bearing rod and the right tension bearing rod are respectively provided with male threads matched with the left and right parts of the internal thread of the internal threaded sleeve; and wherein the end parts of the left tension bearing rod and the right tension bearing rod are respectively screwed into the left and right parts of the internal thread of the internal threaded sleeve.

3. An apparatus for prestressing a concrete floor of an inclined shaft wall, comprising:

two end bearing components;

a corrugated pipe;

a tension bearing rod piece; and two anchor heads;

wherein the tension bearing rod piece is composed of a left tension bearing rod, a right tension bearing rod, and a loading mechanism;

wherein the left tension bearing rod and the right tension bearing rod are connected integratedly by the loading mechanism;

wherein the tension bearing rod piece passes through the corrugated pipe, with two ends exposed by a set length;

wherein the two end bearing components are respectively arranged at a left end and a right end of the tension bearing rod piece in a sleeving manner;

wherein the two anchor heads respectively lock the left and right end bearing component;

wherein the loading mechanism is composed of a U-shaped connection piece, a baffle plate, and two nuts;

wherein a back side of a curved section of the U-shaped connection piece is connected to the left tension bearing rod;

wherein the baffle plate is fixed at an end part of the right tension bearing rod;

wherein two through holes in total are provided on the baffle plate;

wherein two legs of the U-shaped connection piece are sleeved into the two through holes respectively;

wherein the two legs of the U-shaped connection piece are provided with male threads; and wherein the two nuts are respectively screwed onto the two legs of the U-shaped connection piece.

4. The apparatus for prestressing the concrete floor of the inclined shaft wall according to claim 1, wherein:

the loading mechanism is composed of a work anchor, a tool anchor, and two jacks;

the left tension bearing rod is a first left tension beating rod and the tension bearing rod piece is further composed of a second left tension bearing rod, wherein end parts of the first left tension bearing rod and the second left tension bearing rod are symmetrically fixed on two sides of the work anchor;

other ends of the first and second left tension bearing rods are connected to a first one of the anchor heads in one of the following two ways: the two left tension bearing rods pass through a same hole in the first one of the anchor heads and then are fixed, or the two left tension bearing rods respectively pass through two holes in the first one of the anchor heads and then are fixed;

a middle part of the work anchor is provided with a conical hole;

a head part of the right tension bearing rod passes through the conical hole of the middle part of the work anchor, then passes through a preset conical hole in the tool anchor, and the right tension bearing rod is selflocked onto the work anchor and the tool anchor by clamps; and the two jacks are located symmetrically between the work anchor and the tool anchor.

* * * * *